US006067020A

United States Patent [19]

Wimmer

[11] Patent Number: 6,067,020

[45] Date of Patent: May 23, 2000

[54] APPARATUS FOR RETARDING DROWSINESS

[76] Inventor: B. David Wimmer, 7113 Greenhill Trail, North Richland Hills, Tex. 76180

[21] Appl. No.: 09/271,073

[22] Filed: Mar. 17, 1999

Related U.S. Application Data

[63] Continuation-in-part of application No. 08/999,209, Dec. 29, 1997, abandoned.

[51] Int. Cl.[7] ..... G08B 23/00

[52] U.S. Cl. ..... 340/575; 340/576; 340/391.1; 340/693.9; 340/693.11

[58] Field of Search ..... 340/575, 576, 340/691, 689, 693.5, 693.11, 573.1, 573.7, 693.6, 693.9, 391.1; 200/538; 116/1, 28 R, 67 R, 137 R; 361/679

[56] References Cited

U.S. PATENT DOCUMENTS

| | | | |
|---|---|---|---|
| 3,045,225 | 7/1962 | Baldwin | 340/575 |
| 3,938,123 | 2/1976 | Warner | 340/575 |
| 3,999,177 | 12/1976 | Greene | 340/575 |
| 4,272,764 | 6/1981 | Herr et al. | 340/575 |
| 4,354,179 | 10/1982 | Fourcade | 340/575 |
| 4,361,834 | 11/1982 | King | 340/575 |
| 4,938,476 | 7/1990 | Brunelle et al. | 272/93 |
| 5,469,143 | 11/1995 | Cooper | 340/575 |
| 5,522,092 | 6/1996 | Streb et al. | 2/209.13 |
| 5,581,239 | 12/1996 | Lin | 340/575 |
| 5,684,461 | 11/1997 | Jones | 340/575 |
| 5,841,354 | 11/1998 | Bae et al. | 340/575 |
| 5,907,282 | 5/1999 | Tuorto et al. | 340/576 |
| 5,939,989 | 8/1999 | Bang | 340/575 |

*Primary Examiner*—Daniel J. Wu
*Assistant Examiner*—Toan N. Pham
*Attorney, Agent, or Firm*—Felsman Bradley Vaden Gunter & Dillon, LLP; James E. Bradley

[57] ABSTRACT

A device for retarding drowsiness has a housing adapted to be worn on a user's head. The device uses a metal pendulum housed within the housing that comes into contact with electrical contacts to complete an electrical circuit to produce an audible alarm to warn the user when the user's head is inclined to a certain degree, such as when the user begins to doze off. An earphone that can be worn in the user's ear is also provided and connected to the housing.

1 Claim, 3 Drawing Sheets

APPARATUS FOR RETARDING DROWSINESS

CROSS REFERENCE TO RELATED APPLICATION

This application is a Continuation-In-Part of application Ser. No. 08/999,209, filed Dec. 29, 1997 abandoned Mar. 18, 1997.

BACKGROUND OF THE INVENTION

1. Field of the Invention:

This invention relates in general to alarms used to waken or keep one awake, and in particular, to such devices that can be worn on the head to detect the nodding of the head when one is engaged in an activity that requires the maintenance of an alert status.

2. Description of the Prior Art:

There have been several devices in the past that have been used to keep one awake or alert, especially during monotonous activities such as driving, where there is a likelihood that one may fall asleep. These devices often are designed to attach to the user's head to detect tilting or nodding of the head that often occurs when one begins to fall asleep while in an upright position.

The prior art devices have commonly employed mercury switches that rely on the flow of mercury that results from changes in the position of the head. Such a device is described in the published French patent application No. 137,910, filed Apr. 7, 1980. The flow of mercury actuates an electrical warning device that creates an audible alarm or vibration that can be detected by the user when in a drowsy or sleeping state, thus prompting them awake. While the mercury switches may be effective, the mercury used for such switches is highly toxic. As a result the use of mercury switches has been curtailed in preference of safer devices.

What is therefore needed is a device that can be used to awaken or prevent one from falling asleep by detecting tilting or movement of the user's head and which does not employ a mercury switch for detecting such motion.

SUMMARY OF THE INVENTION

A device for retarding drowsiness has a housing adapted to be worn on a user's head. An electrical circuit is at least partially housed within the housing. A sound emitter is coupled to the electrical circuit, with the sound emitter being attached to the housing for emitting an audible alarm. A battery power supply is mounted within the housing and coupled to the electrical circuit for energizing the electrical circuit. At least one electrical contact is coupled to the electrical circuit and mounted within the interior of the housing.

An electrically conductive pendulum is suspended within the interior of the housing so that the pendulum is free to swing within the housing. The pendulum has a free end and a suspended end. The suspended end of the pendulum is coupled to the electrical circuit. The free end of the pendulum moves between a first position and a second position in response to movement of the housing upon the user's head beyond a selected degree. When the pendulum is in the first position, the electrical circuit is maintained open. The free end of the pendulum contacts the at least one electrical contact when in the second position so that the electrical circuit is closed. This causes the sound emitter to emit the audible alarm to facilitate awakening of the user.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

Figure 1:
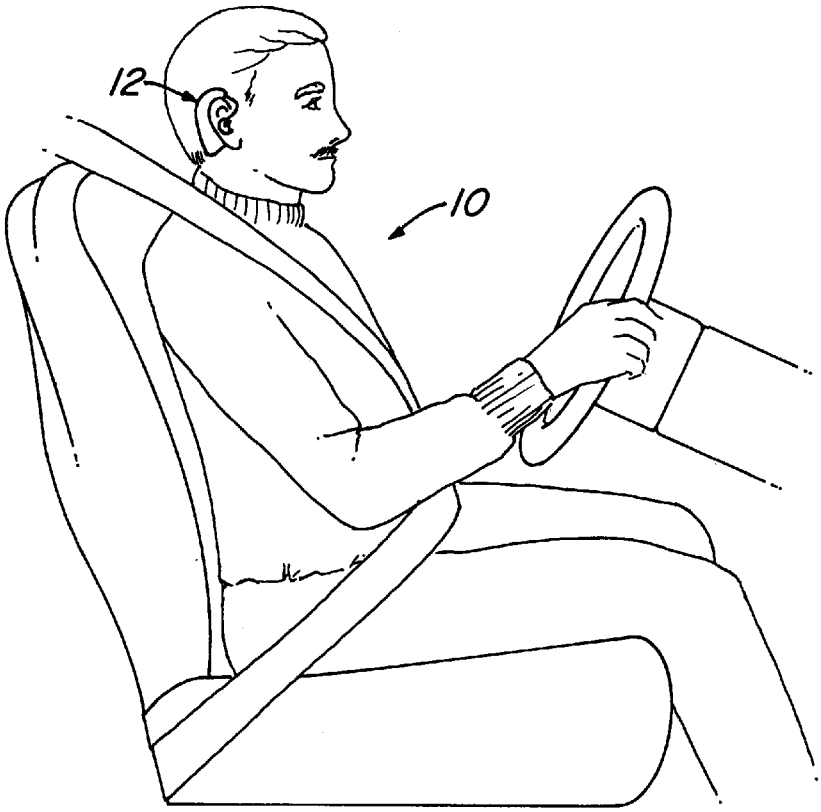
FIG. 1 is a side view of a device for retarding drowsiness constructed in accordance with the invention being worn by a user while driving to keep the user from falling asleep.

FIG. 1 shows a user 10 engaged in the activity of driving an automobile. Because activities such as this require the user to maintain an awake and alert status, the user is provided with an alarm device 12 that will warn the driver 10 when he begins to fall asleep. The device 12 is configured to be worn behind the user's ear, as shown.

Figure 2:
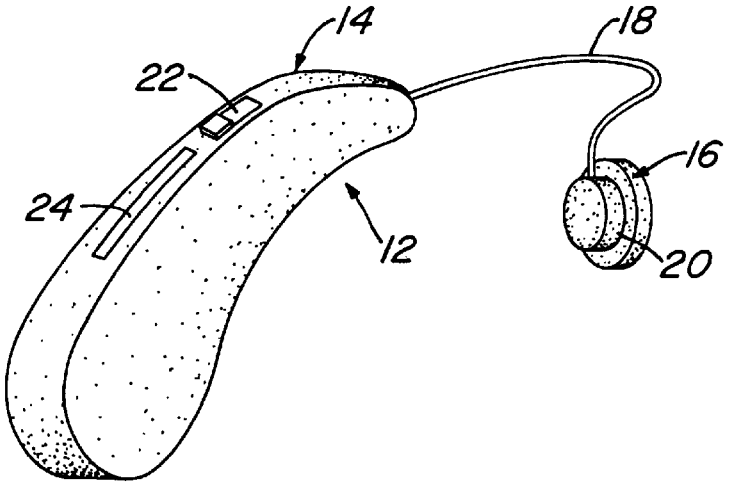
FIG. 2 is a perspective view of the device of FIG. 1, showing the device housing and a sound emitter.

Referring to FIG. 2, the device 12 consists of a housing 14, which houses the internal components of the device, and an earphone or sound emitter 16, which is attached to the housing 14 by a flexible insulated wire 18. The housing 14 is tapered to a narrow upper end that projects forward over the top of the ear when worn behind the user's ear. The housing 14 is either formed of a soft flexible rubber material or is covered with such material to provide a comfortable fit. The earphone 16 is configured to be worn or inserted within the user's ear, as shown in FIG. 1. The ear phone 16 is approximately one-half inch in diameter and approximately one-quarter inch thick. The earphone 16 is covered in a foam sponge material 20 to provide a snug fit within the ear.

Located in the back and near the upper end of the housing 14 is an on/off switch 22. The switch 22 is located at the back of the housing so that it is accessible when the housing is mounted behind the ear. The switch 22 allows the device to be selectively turned on and off.

Also located in the back of the housing is a battery access slot 24. The slot 24 allows a battery 26 (FIG. 4) to inserted and removed from the housing interior. The battery 26 is a disk-type battery, such as those used in hearing aids. The size of the battery depends upon the voltage required by the sound emitter 16. The sound emitter 16 is connected by wire 18 to the battery 26 through the on/off switch 22 so that the sound emitter can be selectively turned on and off if desired.

Figure 3:
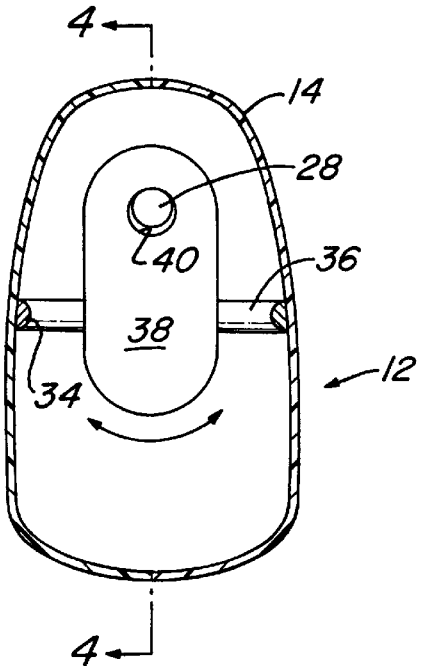
FIG. 3 is a cross-sectional side view of the device housing, showing the housing interior.

Referring to FIG. 3, located within the housing 14 is a transverse rod 28 formed of an electrically conductive material. The rod 28 has a circular cross section. The ends of the rod 28 are seated within the sides of the housing 14. A metal piece 30 (FIG. 4) is electrically coupled and extends from the rod 28 and contacts one side of the battery 26, holding the battery in place against the interior wall of the housing 14.

Embedded within the rubber material of the housing 14 is another metal lead 32, which contacts the opposite side or terminal of the battery 26. The metal lead 32 is connected to four metal contacts 34, preferably copper, which project from the interior wall of the housing and are located at approximately 90° intervals around the interior periphery of the housing 14. The contacts 34 are electrically coupled together by a metal conductor 36. Alternatively, the contacts 34 may be formed from a continuous band of conductive material formed as a ridge around the interior periphery of the housing 14 or may be formed from separate pieces located at various intervals as described.

Figure 4:
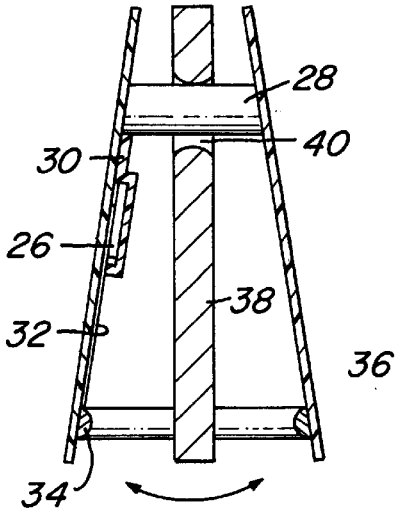
FIG. 4 is a cross-sectional view of the housing shown in FIG. 3, taken along the lines 4—4.

Suspended at one end on the rod 28 is a generally flat metal disk or pendulum 38. The disk is oblong in shape, as shown in FIG. 3, and has a hole or aperture 40 formed off center at the upper end of the disk 38. The disk 38 is preferably formed of copper, but may be of any other conductive metal. The hole 40 is slightly greater in diameter than the rod 28, which extends through the hole 40, so that the disk 38 is allowed to swing freely upon the rod 28. The edges of the aperture, as shown in FIG. 4, are convex curves to facilitate transverse or side-to-side swinging motion of the disk 38 upon the rod 28. With the disk 38 mounted upon the rod 28, the disk is in electrical contact therewith.

As can be seen in FIG. 4, the housing tapers inward toward the upper end to a vertex. The limited space of the housing 14 formed by the vertex causes the disk 38 to be generally maintained in a centered position upon the rod 28. The sidewalls of the housing 14 are sloped at an angle of approximately 17 to 20 degrees from the sides or longitudinal axis of the disk when the disk is vertical and centered upon the rod 28, as shown in FIG. 4, to provide a clearance as the disk 38 is swung between the vertical and contact positions. Likewise, the edges of the disk 38 are spaced from the contacts 36 at the front and back of the housing 14 when the disk is centered so that the edges of the disk will touch the contacts 34 when the disk is rotated or swung between about 17 to 20 degrees from the vertical or centered position.

Figure 5:
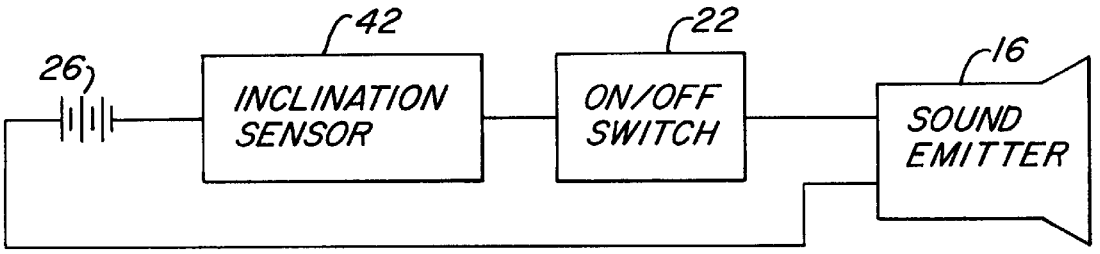
FIG. 5 is a electrical schematic of the device, constructed in accordance with the invention.

Referring to FIG. 5, a schematic of the device circuitry is shown. The rod 28, disk 38 and contacts 34 cooperate together to form an inclination sensor 42. The inclination sensor 42 is connected in series to the battery 26, the on/off switch and the sound emitter 16. With the switch 22 in the on position, when the disk 38 is inclined within the housing 14 so that it touches one of the contacts 34, the circuit shown in FIG. 5 is completed so that the sound emitter creates an audible warning alarm. The on/off switch allows the alarm to be turned off, if desired, even when contact is being made between the disk 38 and contacts 34.

In operation, the housing 14 is mounted behind the ear and the earphone 16 is inserted into the ear. With the housing 14 mounted behind the ear and the user's head is generally upright, the disk 38 should generally be in a centered and vertical position, as shown in FIGS. 3 and 4. It is important that the disk not to be closer to one contact or the other when the device is mounted to the ear. The weight of the free end of the disk 38 and the sloped sidewalls of the housing 14 will generally maintain the disk 38 in this vertical, centered position. The on/off switch 22 should be switched to the on position. Because the electrical contacts 34 are spaced from the disk 38 a distance, the inclination sensor 42 will produce no alarm when slight movements of the head are made.

When the head is tilted to the side or to the front or back, such as occurs when one begins to doze off, the disk 38 will swing or rotate within the housing 14 to a contact position with one of the contacts 34. When the disk 38 comes into contact with one of the contacts 34 on the interior periphery of the housing, the circuit shown in FIG. 5 will be closed or complete and the sound emitter or earphone 16 will produce the audible alarm, thus warning the user that they are falling asleep or causing the user to awaken. When the head is brought to the upright position upon awakening, the disk 38 will again be moved to the centered position so that the circuit is open and no alarm is produced. If desired, the device can be switched off by means of the on/off switch 22

Figure 6:
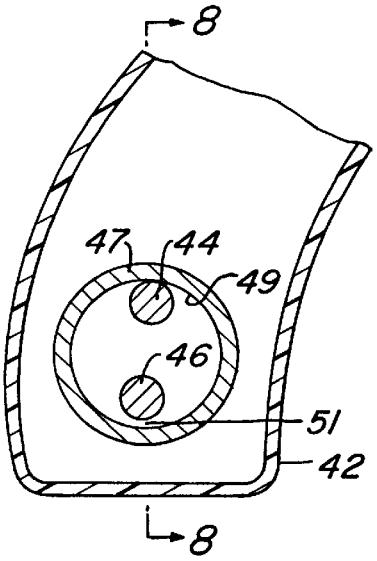
FIG. 6 is a partial sectional view of a second embodiment of a device for retarding drowsiness, with the wiring and batteries not being shown for clarity.
Figure 8:
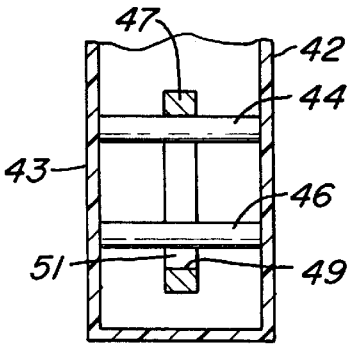
FIG. 8 is a sectional view of the device of FIG. 6, taken along the line 8—8 of FIG. 6.

A second embodiment is shown in FIG. 6. The device has a housing 42 which may be similar to the housing 14 of the first embodiment, except that tapered sidewalls are not required. Housing 42 does not show the battery or electrical circuitry for clarity. A conductor rod 44 extends transversely across housing 42 between its lateral sidewalls 43 (FIG. 8). A lower rod 46 extends between sidewalls 43 at a selected distance below upper rod 44. Lower rod 46 is also a conductor. Rods 44, 46 are connected to a battery such as battery 26 of FIG. 5. When electrical continuity is established between rods 44, 46, a sound emitter such as sound emitter 16 (FIG. 5) will emit an alarm.

Figure 7:
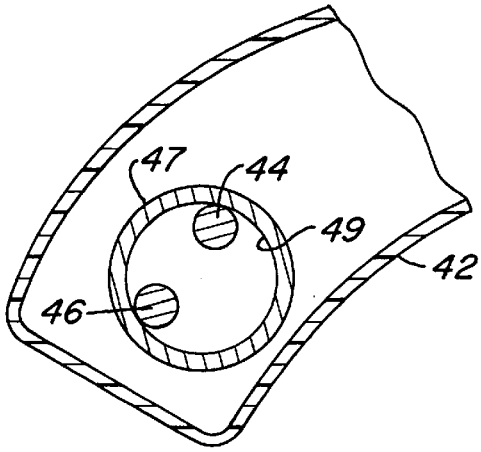
FIG. 7 is a view of the device of FIG. 6, shown tilted forward.
Figure 9:
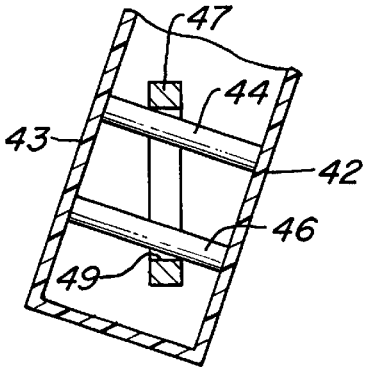
FIG. 9 is a sectional view of the device of FIG. 6, taken along the line 8—8, but shown tilted laterally.

A pendulum 47 is carried by upper rod 44. Pendulum 47 is a circular disk in a preferred embodiment in the shape of a washer. It has an outer diameter and an inner diameter 49. The inner diameter 49 is larger than the distance from the upper side of upper rod 44 to the lower side of lower rod 46. This results in a clearance 51 when housing 42 is in the upright position. There is no electrical continuity in this position between cross members 44, 46. When housing 42 is tilted forward or rearward, however, a portion of the inner diameter 49 will come into contact with lower rod 46 as shown in FIG. 7. This completes the circuit, causing sound emitter 16 (FIG. 5) to sound. Similarly, as shown in FIG. 9, if tilted laterally, inner diameter 49 of pendulum 47 will contact lower rod 46 to complete the circuit.

The invention has several advantages over the prior art. It is simple in design and easy to operate. Because no mercury switches are used, it is safe to use and creates no environmental disposal problems.

While the invention has been shown in only one of its embodiments it should be apparent to those skilled in the art that it is not so limited but is susceptible to various changes without departing from the scope of the invention.

I claim:

1. A device for retarding drowsiness comprising:

a housing adapted to be worn behind a user's ear, the housing having at least two side walls;

an electrically conductive transverse upper cross member mounted between the side walls;

an electrically conductive transverse lower cross member mounted between the side walls;

an electrical circuit at least partially housed within the housing, the cross members being coupled to the electrical circuit;

an earphone coupled to the electrical circuit and attached to the housing, the earphone being adapted to be fitted in the user's ear for emitting an audible alarm;

a conductive disk having a circular hole which receives both of the cross members and is supported on the upper cross member, the disk having an inner diameter at the hole that is greater than a distance between the cross members to avoid completing an electrical path between the cross members while the device is in an alert position, and when the device is tilted, the inner diameter touching the lower cross members to complete an electrical path for sounding an alarm.

* * * * *